US005618112A

United States Patent [19]

Lovell

[11] Patent Number: 5,618,112

[45] Date of Patent: Apr. 8, 1997

[54] BREAK-OPEN CARD WITH TAMPER PROOF SEAL

[75] Inventor: John G. Lovell, Knoxville, Tenn.

[73] Assignee: Stuart Enterprises, Inc., Council Bluff, Iowa

[21] Appl. No.: 498,092

[22] Filed: Jul. 5, 1995

[51] Int. Cl.[6] ..... B42D 15/00

[52] U.S. Cl. ..... 283/103; 283/100; 283/903

[58] Field of Search ..... 283/98, 99, 100, 283/103, 117, 903, 72, 101, 102

[56] References Cited

U.S. PATENT DOCUMENTS

| | | | |
|---|---|---|---|
| 3,854,581 | 12/1974 | Jones, Jr. | 206/460 |
| 4,120,445 | 10/1978 | Carrier et al. | 229/53 |
| 4,121,003 | 10/1978 | Williams | 428/40 |
| 4,174,857 | 11/1979 | Koza | 283/6 |
| 4,371,196 | 2/1983 | von Kempski et al. | 283/7 |
| 4,454,956 | 6/1984 | Patterson | 220/214 |
| 4,709,396 | 11/1987 | Voshall et al. | 383/5 |
| 4,721,638 | 1/1988 | Matsuguchi et al. | 428/40 |
| 4,738,472 | 4/1988 | Shibata | 283/101 |
| 4,980,222 | 12/1990 | Rivera et al. | 428/195 |
| 5,013,088 | 5/1991 | Marin | 283/81 |
| 5,082,702 | 1/1992 | Alband | 428/36.92 |
| 5,153,042 | 10/1992 | Indrelie | 428/40 |
| 5,193,854 | 3/1993 | Borowski et al. | 283/87 |
| 5,358,281 | 10/1994 | Greig | 283/81 |
| 5,451,052 | 9/1995 | Behm et al. | 283/903 X |
| 5,494,317 | 2/1996 | Johnson | 283/903 X |

*Primary Examiner*—Willmon Fridie, Jr.
*Attorney, Agent, or Firm*—Pitts & Brittian, P.C.

[57] ABSTRACT

A break-open card with tamper proof seal (10) to prevent surreptitious tampering with and presentment of tampered game cards as valid prize winning cards by providing at least one readily frangible seal (28) to irreversibly evidence that tampering. The break-open card with tamper proof seal (10) includes a first substrate (12) comprising a first surface (14) and a second surface (16), having prize winning indicia (18) disposed on its first surface (14) and instructional indicia (20) disposed on its second surface (16); a second substrate (22) comprising a top surface (24) having advertising and descriptive indicia (30) disposed on the top surface (24), a bottom surface securably attached to the first surface (14) of the first substrate (12), at least one perforation (32) disposed on the second substrate (22), and at least one tamper proof seal (28) disposed on the top surface (24) of the second substrate (22) so as to cross and secure the at least one perforation (32) on the top surface (24) of the second substrate (22) The tamper proof seal (28) fragments or disfigures upon contact by surgical or related instruments or upon interaction with the at least one perforation (32) on the top surface (24) of the second substrate (22).

12 Claims, 4 Drawing Sheets

BREAK-OPEN CARD WITH TAMPER PROOF SEAL

TECHNICAL FIELD

This invention relates to the field of game cards and lottery tickets and, more particularly, to marking "break-open" game cards with a tamper proof seal which disfigures when a game card is opened and renders any attempted surreptitious tampering readily discernible.

BACKGROUND ART

In the field of game cards, lottery tickets, and other similar games of chance, it is well known that the security of the prize winning indicia is always of paramount concern to the game manufacturer and sponsor. This concern derives from the desire to maintain the integrity of the particular game and the notion of equity and fairness in gamesmanship.

The level of this concern has been heightened recently by the evolution of methods by which individuals may surreptitiously gain insight into the prize winning indicia of a particular game card or lottery ticket and deceive the vendor as to the individual's right to claim a particular prize. The more commonly known methods of illicit prize detection include heating adhesive seals and later resealing them; chilling the adhesive with a refrigerant to make it brittle and later regluing the seal; and, illuminating the game card using infra red, optic fibers, lasers, x-ray or powerful conventional light sources to reveal their contents.

Numerous tamper detection devices have been produced in response to these evolving methods of fraud. The majority of these devices focus on the use of tapes, labels or other methods designed to evidence tampering including color contrasting, disintegration and resistance to resealing.

Typical of the art are those tamper detection devices disclosed in the following U.S. Patents:

| U.S. Pat. No. | Inventor(s) | Issue Date |
|---|---|---|
| 3,854,581 | E. C. Jones, Jr. | Dec 17, 1974 |
| 4,120,445 | Carrier, et al. | Oct 17, 1978 |
| 4,121,003 | F. P. Williams | Oct 17, 1978 |
| 4,174,857 | J. R. Koza | Nov 20, 1979 |
| 4,371,196 | W. von Kempski, et al. | Feb 01, 1983 |
| 4,454,956 | R. A. Patterson | Jun 19, 1984 |
| 4,709,396 | D. K. Voshall, et al. | Nov 24, 1987 |
| 4,721,638 | T. Matsuguchi, et al. | Jan 26, 1988 |
| 4,738,472 | T. Shibata | Apr 19, 1988 |
| 4,980,222 | R. R. Rivera, et al. | Dec 25, 1990 |
| 5,013,088 | T. C. Marin | May 07, 1991 |
| 5,082,702 | T. D. Alband | Jan 21, 1992 |
| 5,153,042 | K. W. Indrelie | Oct 06, 1992 |
| 5,193,854 | J. C. Borowski, et al. | Mar 16, 1993 |
| 5,358,281 | W. G. Greig | Oct 25, 1994 |

The '581 patent issued to Jones; the '956 patent issued to Patterson; the '222 patent issued to Rivera, et al.; and, the '702 patent issued to Alband disclose tape devices. The '581 patent issued to Jones discloses a pressure-sensitive tape which evidences tampering by wrinkling or tearing when removal is attempted. The '956 patent to Patterson discloses a pre-folded polymeric tape which seals metal beverage containers and evidences tampering by unfolding when access is sought by pulling or tearing the extended tab. The '638 patent to Matsuguchi, et al., discloses a laminate adhesive material and a method for the manufacture of adhesive material which prevents resticking for use with such items as package security stickers and price tags. The '222 patent to Rivera, et al., discloses a closure tape comprising a phase separated polymer film and color indicia which reflects tampering when the phases of the film polymer and the color indicia are disrupted by attempted removal of the tape. The '702 patent to Alband discloses a similar tape having a light transmissive film which evidences tampering by revealing patterns of printed characters when the film is disrupted.

In each instance, these tape devices predicate their effectiveness in detection of tampering upon the attempted or actual removal of the tape device. For example, the '581 tape requires removal for wrinkling; the '638 tape requires removal to display its single use properties; and, the '222 and '702 tapes require removal for separation of their respective components. They make no provision for detecting tampering by other means, such as by penetration or incision and resealing. Moreover, each of these tapes assumes that the compromise of the tape will occur in a manner which is parallel to the tape; that is, that the tape will be peeled off or lifted. They do not address, provide for, or guard against, an invasion of the sealed object where removal of the tape is not attempted but where the invasion of the object occurs in a direction perpendicular to the tape. Nor do these devices address methods for exposing such invasions. For example, the meticulous penetration or cutting by a surgical instrument will not disrupt, delaminate or deface the '003 label. Nor will such an invasion activate or otherwise trigger the light transmissive properties of the film of the '702 patent to Alband. Consequently, the tape devices disclosed in these patents are inadequate to detect and reveal the fraud practiced by individuals using surgical or related instruments to discretely and meticulously cut into game cards, expose prize winning indicia, restore the card to what appears to be an unused or unaltered condition to an untrained or unobservant eye, and return the game card to claim another ticket or a game winning prize. Tape devices are equally ineffective as a method for detecting tampering in game cards or other related games of chance as an incision in a tape on a game card is just as effectively concealed as an incision in the perforations of the game card itself. Further, tape devices are limited in their application and unrelated to latex silk-screening or printing as methods for tampering detection.

The '003 patent issued to Williams; the '472 patent issued to Shibata; the '088 patent issued to Marin; the '042 patent issued to Inderlie; and, the '281 patent issued to Greig disclose label devices. The '003 patent issued to Williams discloses a label which delaminates and is defaced if transferred from one object to another. The '472 patent to Shibata discloses a thermo-sensitive single use label. The '088 patent to Marin discloses a masking or block label containing a plurality of cuts on the label which disintegrates upon attempted removal. The '042 patent issued to Indrelie discloses a multi-layered adhesive label which also disintegrates upon separation and provides literal warnings of tampering. The '281 patent issued to Greig discloses a label in which the label face separates from the adhesive coat disposed on the rear of the label to reveal evidence of tampering.

The deficiencies of the label devices for tampering detection are identical to those of the tape devices as label devices also predicate their effectiveness on the attempted or actual removal of the device and the expectation that compromise will occur in a direction parallel to the plane of the label.

Consequently, these devices also fail to provide for detection of tampering by any other means. Each of these labels fails to detect tampering where that tampering is a cutting or a relatively perpendicular penetration rather than a removal of the security device. Use of surgical or related instruments are equally as effective in illicitly defeating these label devices as they are with tape devices. As examples, a meticulous surgical cut will not disrupt, delaminate or deface the '003 label. Neither will a similar surgical cut activate or otherwise trigger the reactivity of a thermosensitive label such as that of the '472 patent. Nor will such a cut be reflected in the separable label of the '821 patent, especially if regluing accomplished.

Thus, the label devices disclosed in these patents are equally ineffective to reveal fraud practiced by individuals who discretely and meticulously cut into game cards to reveal essential prize information and restore the card to what appears to be an unused condition to an untrained or unobservant eye. As with tape devices, label devices are equally ineffective indicators of incision-type tampering on the game card or other related games of chance as an incision in a label on a game card is just as effectively concealed as an incision in the perforations of the game card itself. Further, labelling is also distinguishable from the present invention as it is unrelated to latex silk-screening or printing as methods for tampering detection.

The '445 patent issued to Carrier, et al.; the '857 patent issued to Koza; the '196 patent issued to von Kempski; the '396 patent issued to Voshall, et al.; and, the '854 patent issued to Borowski, et al., disclose several unrelated additional methods of tampering detection.

The '445 patent issued to Carrier, et al., discloses a multi-strata pouch which reveals evidence of surreptitious compromise by undergoing an irreversible color change when exposed to chemical or heat agents. The multi-strata pouch of the '445 patent is inapplicable to problems encountered in the game card or lottery ticket industry. It does not protect against tampering by any other means, such as by surgical or related instruments. Nor does it assist in detecting attempts to compromise the security of the pouch using such instruments. Moreover, the security pouch is unrelated to methods of tampering detection using latex silk-screened or printed indicia of the present invention.

The '857 patent to Koza discloses a rub-off game ticket which utilizes postage stamp-type perforations and metallic foil as a method to prevent unwanted disclosure of information and to detect tampering. The game ticket of the '857 patent is fundamentally inapplicable to the subject invention as it relates to rub-off or scratch coat-style game tickets and protection of the entire ticket but not to protection of the critical areas which disclose game winning indicia. The game ticket of the '857 patent fails to prevent tampering by disposing any indicia or media to evidence tampering to the perforations or the perforated area. More specifically, the '857 game ticket fails to rebuff the skilled and equipped unscrupulous person as such a person defeat the postage style perforations by making minute surgical style cuts into the perforations and gently elevate, without bending, the foil to spy the indicia printed on the ticket and re-seal it. Further, the '857 game ticket patent is limited in application to games where the prize value and the cost-benefits of tampering are minimal.

The '196 patent issued to von Kempski discloses a security filament typically inserted into financial documents and forms of identification. The object of the security filament is to detect forgery and not guard against tampering. The filament of the '196 patent does not solve the problem of tampering with game cards by use of surgical or related instruments, and subsequent regluing. The security filament provides no method or manner of detecting whether a game card has been tampered with and, consequently, fails to prevent or otherwise inhibit this activity. A further disadvantage of the security filament of the '196 patent is that the filament and the equipment to attach the filament to documents must be available to persons making the game cards, resulting in added inconvenience and expense.

The '396 patent to Voshall, et al., discloses an envelope having a pressure sensitive seal that reveals a hidden message when the seal is broken. Like the '445 patent to Carrier, et al., the envelope of the '396 patent is distinguishable from the present invention as it describes a container rather than a game or lottery type card. The pressure sealed envelope of the '396 patent is also inapplicable to game card or lottery ticket situations as the sealing system of the '396 patent is created with the expectation that an individual will attempt to gain access to the envelope by pulling at its border or opening. It makes no provision for protection for tampering by other means including use of surgical or related instruments. The envelope can easily be surreptitiously compromised by cutting across the cohesive layers of the seal without disturbing it or revealing evidence of tampering.

Finally, the '854 patent to Borowski, et al., discloses an article employing a thermo-chromic layer as a means of authenticating a document quickly and on-site; in a manner conceptually similar to the security filament of the '196 patent issued to von Kempski. As with the '196 security filament, this method of authentication bears no relation to the methods of tampering detection of the subject invention.

Therefore, it is an object of this invention to provide a means to prevent tampering with break-open game cards, lottery tickets and related games of chance. Another object of the present invention is to provide the average vendor with a means for quick and accurate detection of surreptitious tampering with such game cards. Still another object of the present invention is to provide for an easily applicable and inexpensive method of tampering detection. A further object of this invention is to protect against unwarranted inspection of break-open game cards, lottery tickets and related games of chance using microsurgical techniques. Yet another object of the present invention is to provide a game card which is secure from surreptitious tampering but easily accessible to and legible by its intended reader.

SUMMARY OF THE INVENTION

Other objects and advantages will be accomplished by the present invention which protects both a vendor and game sponsor against surreptitious tampering with game cards and fraud in the presentment of game cards that have been tampered with as valid prize winning cards by providing a readily frangible seal to irreversibly evidence surreptitious tampering with break-open game cards and other related games of chance.

The break-open card with tamper proof seal of the present invention is constructed of opaque materials in a multi-substrate composition. The break-open card with tamper proof seal includes a first substrate comprising a first surface and a second surface, a second substrate comprising a top surface and a bottom surface, at least one perforation, and at least one tamper proof seal disposed about the top surface of the second substrate. The first substrate contains prize winning indicia disposed about its first surface and instructional indicia concerning the particular game of chance described by the particular break-open game card disposed about its second surface. The second substrate contains advertising and descriptive indicia disposed about its top surface which describe the particular game of the particular break-open card, at least one perforation (commonly called "a window") disposed so as to disclose the prize winning indicia correspondingly disposed about the first surface of the first substrate, and an adhesive disposed about the bottom surface of the second substrate to secure the second substrate to the first substrate in a manner which does not obstruct access to the prize winning indicia through the at least one perforation of the second substrate. At least one tamper proof seal consisting of frangible latex film material is silk-screened or printed onto the top surface of the second substrate and is disposed about the top surface of the second substrate so as to secure the at least one perforation on the top surface of the second substrate. The at least one tamper proof seal readily fragments upon contact by surgical or related instruments or upon interaction with the at least one perforation of the top surface of the second substrate.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A break-open card with a tamper proof seal incorporating various features of the present invention is illustrated generally at 10 in the figures. The break-open card with tamper proof seal 10 is designed to protect both the vendor and the game sponsor against surreptitious tampering with game cards and fraud in the presentment of tampered game cards as valid prize winning cards. The break-open card with tamper proof seal 10 is further designed to enable the average vendor to instantly identify game cards that have been tampered with and are being presented as valid prize winning cards.

Figure 5:
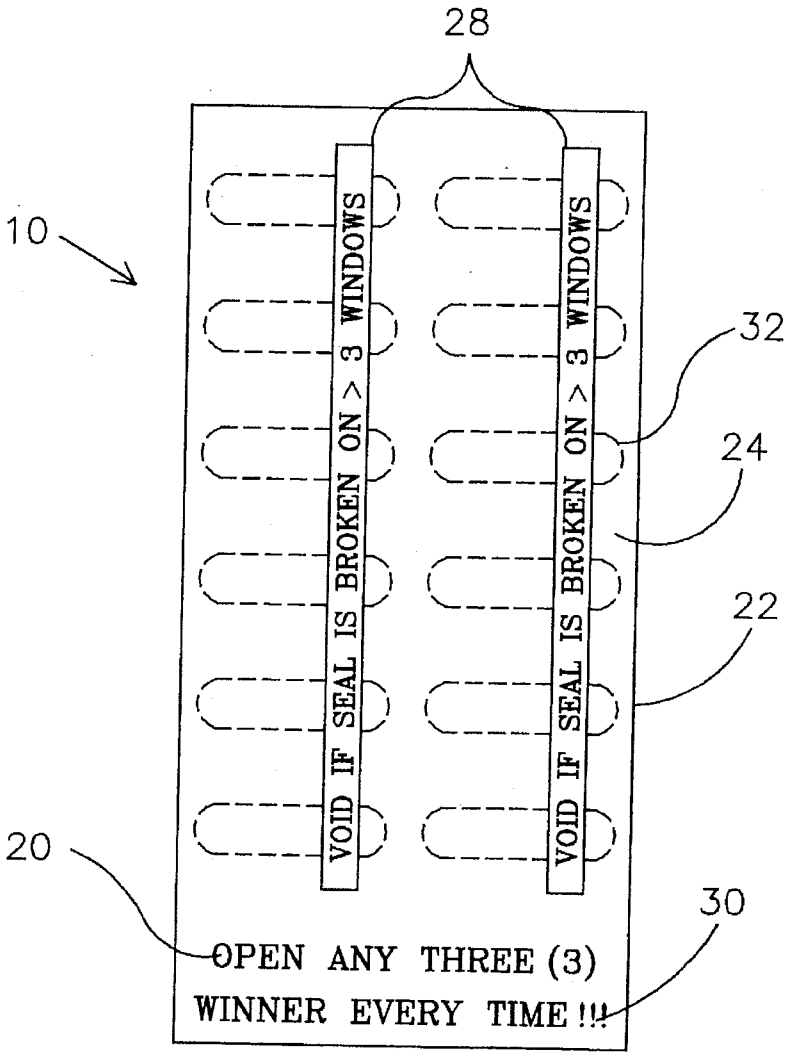
FIG. 5 illustrates a rear elevation view of the alternate embodiment of the break-open card with tamper proof seal.
Figure 4:
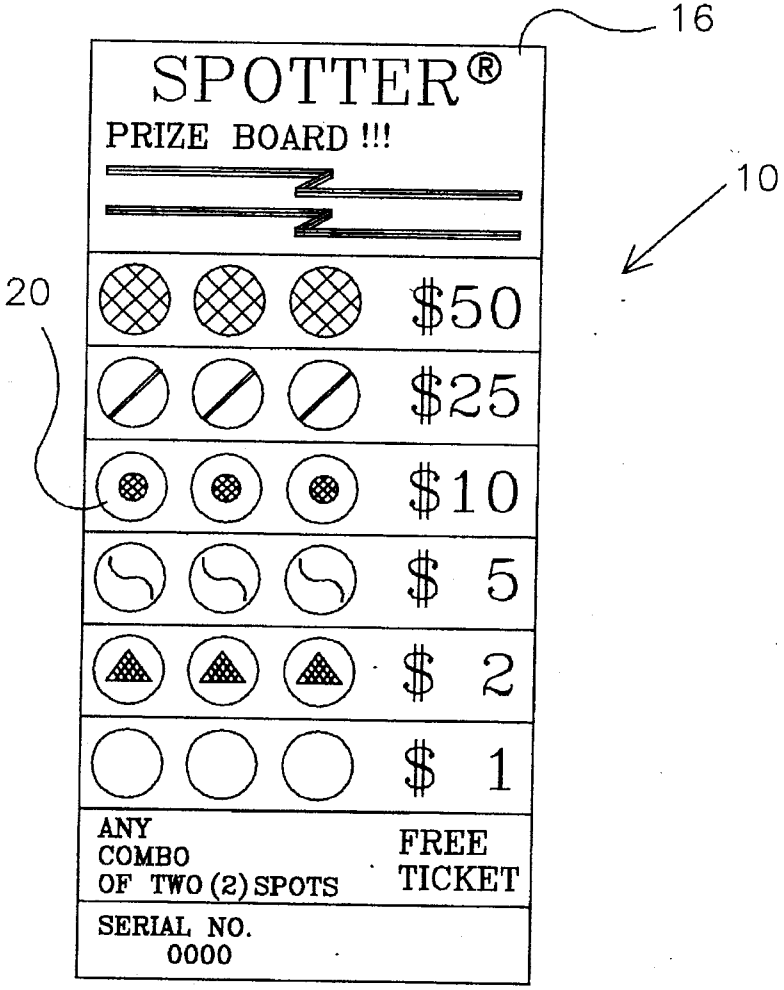
FIG. 4 illustrates a front elevation of an alternate embodiment of the break-open card with tamper proof seal.

The break-open card with tamper proof seal 10 of the preferred embodiment is formed by a break-open card constructed of opaque materials, at least one perforation 32 to disclose prize winning indicia 18, and at least one tamper proof seal 28 which is readily frangible to irreversibly evidence the surreptitious tampering with the at least one perforation 32. The break-open card with tamper proof seal 10 of the preferred embodiment is provided with indicia on three of its surfaces. However, it is recognized by those skilled in the art that break-open cards may similarly be composed of a variable number of substrates of suitable materials with indicia disposed on several of its surfaces. As is exemplified in FIGS. 4 and 5 of the drawings, those skilled in the art will also recognize that break-open game cards may similarly be composed of a variable number of perforations and game winning indicia.

In the preferred embodiment, the break-open game card with tamper proof seal 10 is composed of a first substrate 12 comprising a first surface 14 and second surface 16. Prize winning indicia 18 are disposed on the first surface 14 of the break-open card with tamper proof seal 10. Instructional indicia regarding the particular game of chance described by the break-open card with tamper proof seal 10 are disposed on the second surface 16.

In the preferred embodiment, the break-open game card with tamper proof seal further comprises a second substrate 22 which also consists of a top surface 24 and a bottom surface 26. Advertising and descriptive indicia 30 which advertise and describe the break-open card with tamper proof seal 10 are disposed on the top surface 24 of the second substrate 22. At least one perforation (commonly called "a window") is disposed on the second substrate 22 in a position to suitably correspond with and reveal the prize winning indicia 18 disposed on the first surface 14 of the first substrate 22 when the at least one perforation 32 is opened. The bottom surface 26 of the second substrate 22 is adhesively attached to the first surface 14 of the first substrate 12 by an adhesive which is disposed about the bottom surface 26 of the second substrate 22 between the periphery of the second substrate 22 and the at least one perforation 32.

In the preferred embodiment, at least one tamper proof seal 28 is disposed on the top surface 24 of the second substrate 22 of the break-open card with tamper proof seal 10 in relatively perpendicular manner so as to secure the at least one perforation 32 on the top surface 24 of the second substrate 22 from surreptitious tampering. Those skilled in the art will recognize that the at least one perforation 32 may be secured with equal effectiveness in other manners, such as by diagonally crossing the perforation 32, as exemplified in FIG. 6, or by substantially covering the at least one perforation 32, as exemplified in FIG. 7, with at least one tamper proof seal 28.

Figure 1:
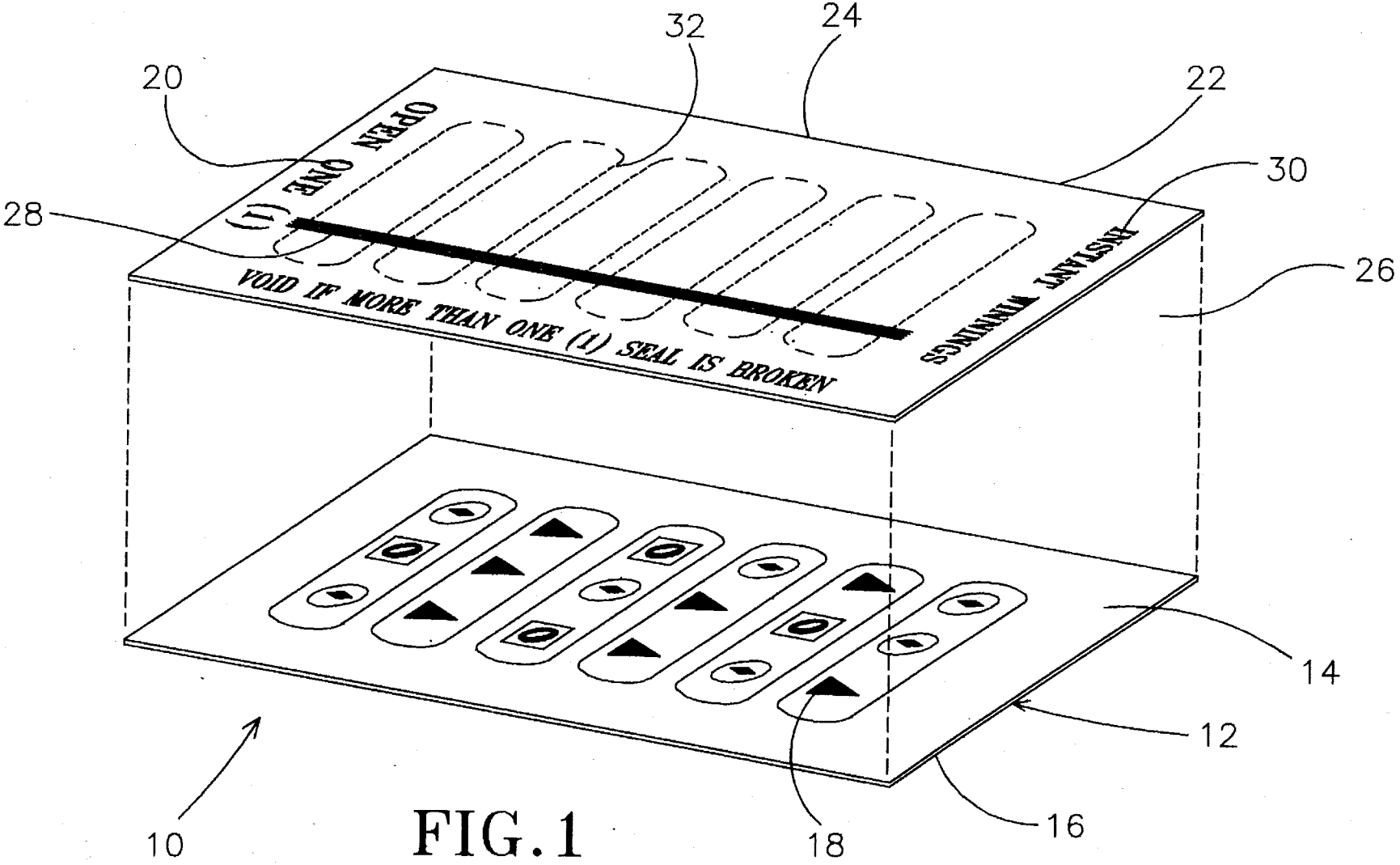
FIG. 1 is an exploded perspective view of the break-open card with tamper proof seal constructed in accordance with several features of the present invention.
Figure 3:
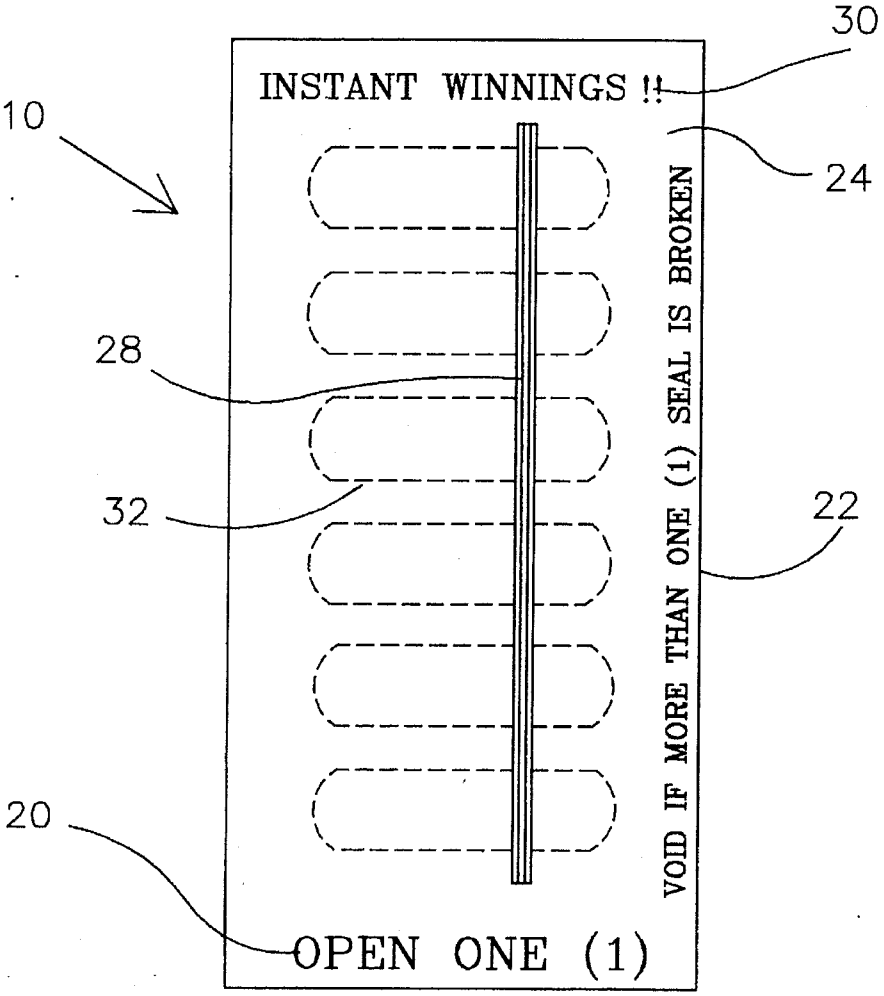
FIG. 3 is a rear elevation view of the break-open card with tamper proof seal.
Figure 2:
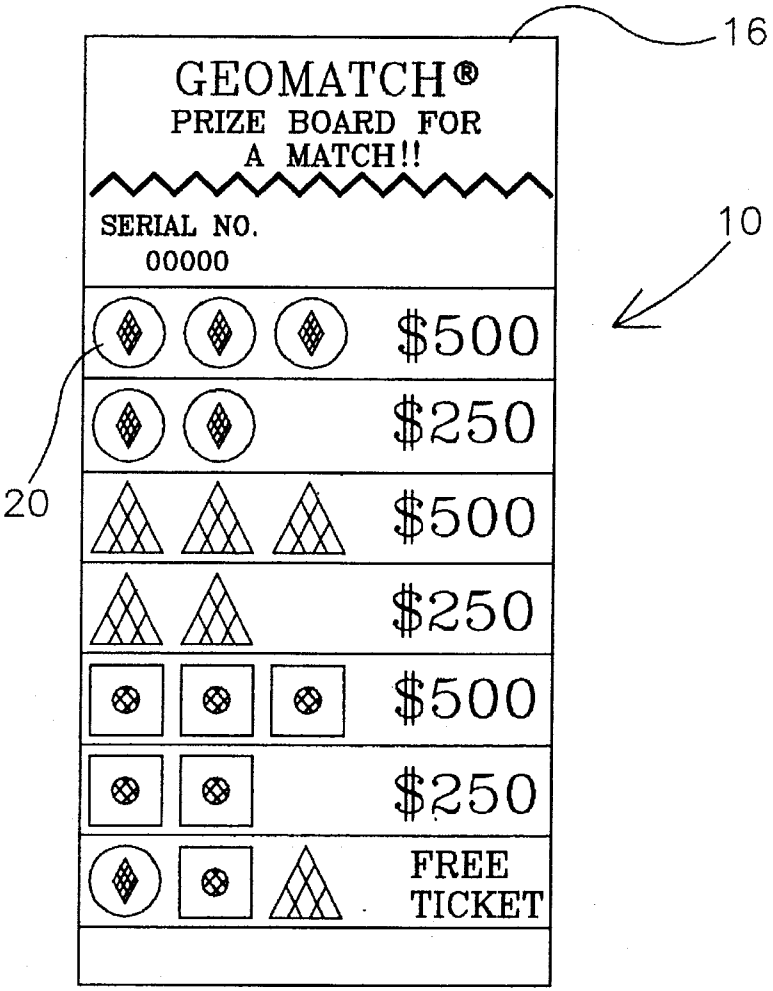
FIG. 2 illustrates a front elevation view of the break-open card with tamper proof seal.
Figure 7:
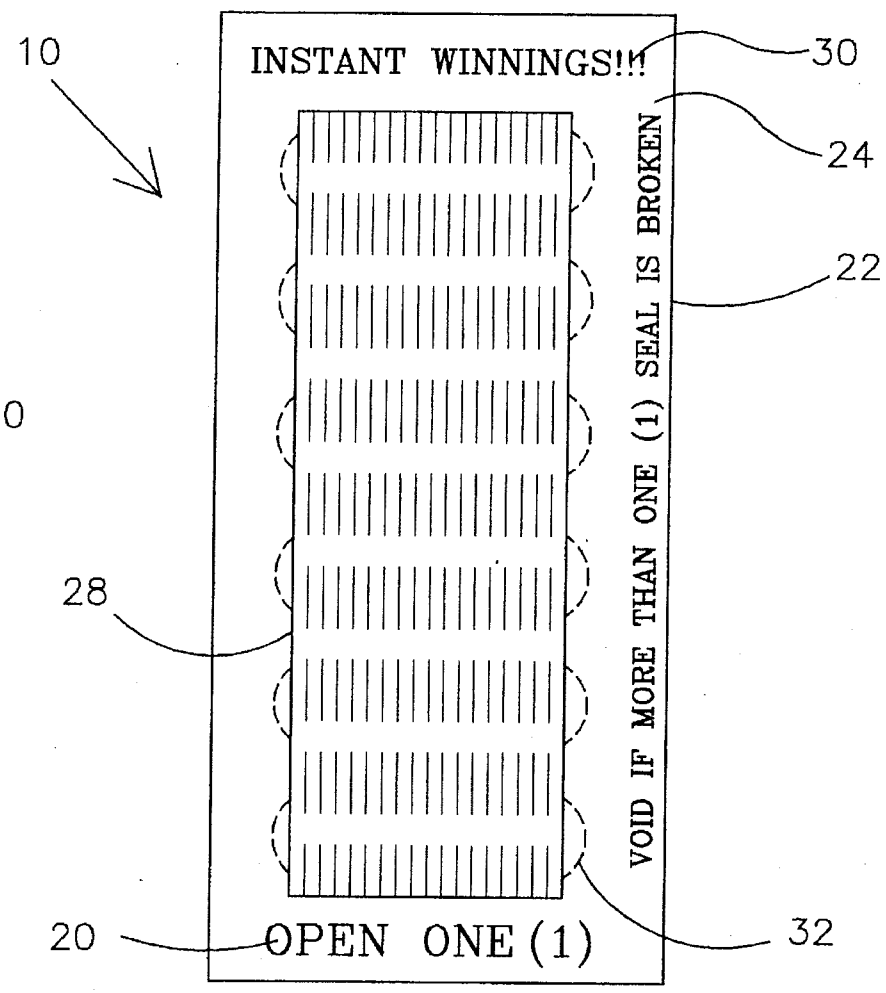
FIG. 7 illustrates a second alternate embodiment of the break-open card with tamper proof seal illustrated in FIG. 3.
Figure 6:
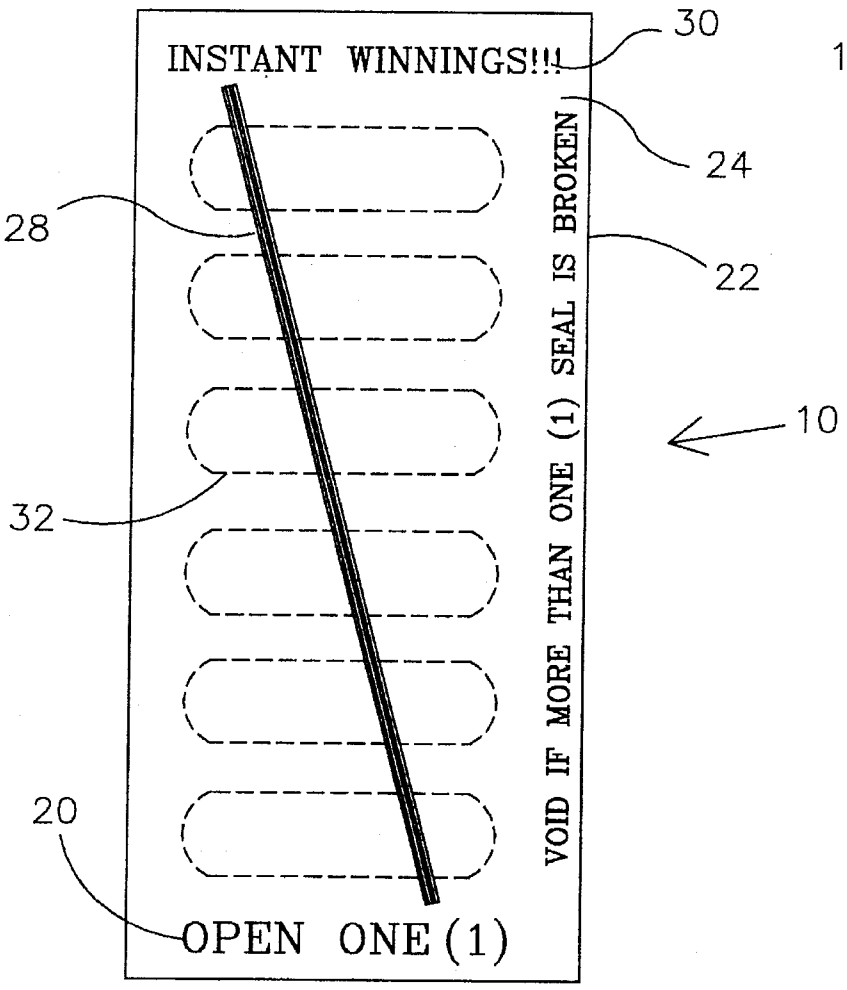
FIG. 6 illustrates an alternate embodiment of the break-open card with tamper proof seal illustrated in FIG. 3.

In the preferred embodiment, the at least one tamper proof seal 28 is composed of frangible, latex materials which are silk-screened onto the top surface 24 of the second substrate 22 and break apart upon contact by surgical or related instruments or by interaction with the at least one perforation 32 of the top surface 24 of the second substrate 22. Those skilled in the art will also recognize that other methods of securing latex materials to the game card 10, including printing, are equally available. They will also recognize that contractile latex materials may be employed with effectiveness equal to that of the frangible latex materials. Further, those skilled in the art will recognize that the at least one tamper proof seal 28 may be deployed in varying dimensions, as is shown in FIGS. 3, 6 and 7.

From the foregoing description, it will be recognized by those skilled in the art that a break-open card with tamper proof seal 10 offering advantages over the prior art has been provided. Specifically, the break-open card with tamper proof seal 10 provides an effective method for detecting tampering on break-open game cards and related games of chance, in general, and especially for detecting tampering by means of surgical or related instruments. The break-open card with tamper proof seal 10 further provides an inexpensive and easily applied method of security whose breach is readily detectable by the average vendor and yet is not discouraging to the legitimate user.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A break-open card with tamper proof seal to readily detect surreptitious tampering by surgical or related instruments, said break-open card with tamper proof seal comprising:

a first substrate having a first surface and a second surface;

a second substrate having a top surface and a bottom surface, said second substrate defining at least one perforation, and said bottom surface of said second substrate securably affixed to said first surface of said first substrate; and at least one tamper proof seal disposed on the top surface of the second substrate such that said at least one tamper proof seal crosses said at least one perforation to secure the break-open from surreptitious tampering and fragment upon manipulation.

2. The break-open card with tamper proof seal of claim 1 wherein said first substrate is fabricated from opaque materials.

3. The break-open card with tamper proof seal of claim 1 wherein said second substrate are fabricated from opaque materials.

4. The break-open card with tamper proof seal of claim 1 wherein said first surface of said first substrate defines a background and at least one prize winning indicia disposed on said background of said first surface.

5. The break-open card with tamper proof seal of claim 1 wherein said second surface of said first substrate defines a background and at least one instructional indicia disposed on said background of said second surface.

6. The break-open card with tamper proof seal of claim 1 wherein said at least one perforation is disposed about said second substrate in corresponding relation to said prize winning indicia disposed on said first surface of said first substrate.

7. The break-open card with tamper proof seal of claim 1 wherein said at least one tamper proof seal is fabricated from frangible latex based materials.

8. The break-open card with tamper proof seal of claim 1 wherein said at least one tamper proof seal is fabricated from contractile latex based materials.

9. The break-open card with tamper proof seal of claim 1 wherein said at least one tamper proof seal is perpendicularly disposed relative to said at least one perforation.

10. The break-open card with tamper proof seal of claim 1 wherein said at least one tamper proof seal is diagonally disposed about said at least one perforation.

11. A break-open card with tamper proof seal to readily detect surreptitious tampering by surgical or related instruments, said break-open card with tamper proof seal comprising:

a first substrate, said first substrate being fabricated from opaque materials, having a first surface and a second surface, and defining a background and at least one prize winning indicia disposed on said background of said first surface, said second surface of said first substrate defining a background and at least one instructional indicia disposed on said background of said second surface;

a second substrate, said second substrate being fabricated from opaque materials and having a top surface and a bottom surface and at least one perforation, said at least one perforation being disposed on said second substrate in corresponding relation to said prize winning indicia disposed on said first surface of said first substrate, and said bottom surface of said second substrate securably affixed to said first surface of said first substrate; and at least one tamper proof seal, said at least one tamper proof seal being constructed from frangible latex materials and disposed on the top surface of the second substrate in relatively perpendicular relation to said at least one perforation such that said at least one tamper proof seal is secured the break-open from surreptitious tampering and fragments upon manipulation.

12. A break-open card with tamper proof seal to readily detect surreptitious tampering by surgical or related instruments, said break-open card with tamper proof seal comprising:

a first substrate, said first substrate being fabricated from opaque materials, having a first surface and a second surface, and defining a background and at least one prize winning indicia disposed on said background of said first surface, said second surface of said first substrate defining a background and at least one instructional indicia disposed on said background of said second surface;

a second substrate, said second substrate being fabricated from opaque materials and having a top surface and a bottom surface and at least one perforation, said at least one perforation being disposed on said second substrate in corresponding relation to said prize winning indicia disposed on said first surface of said first substrate, and said bottom surface of said second substrate securably affixed to said first surface of said first substrate; and at least one tamper proof seal, said at least one tamper proof seal being constructed from frangible latex materials and disposed on the top surface of the second substrate in relatively diagonal relation to said at least one perforation such that said at least one tamper proof seal is secured the break-open from surreptitious tampering and fragments upon manipulation.

* * * * *